US006810918B2

(12) United States Patent
Birner et al.

(10) Patent No.: US 6,810,918 B2
(45) Date of Patent: Nov. 2, 2004

(54) METHOD AND APPARATUS FOR VARIABLY BRAKING THE WEFT THREAD BETWEEN A SUPPLY SPOOL AND A THREAD STORE IN A LOOM

(75) Inventors: Werner Birner, Lindau (DE); Herbert Reinhardt, Achberg (DE); Christian Hannes, Wangen (DE)

(73) Assignee: Lindauer Dornier Gesellschaft mbH, Lindau (DE)

( * ) Notice: Subject to any disclaimer, the term of this patent is extended or adjusted under 35 U.S.C. 154(b) by 168 days.

(21) Appl. No.: 10/272,696

(22) Filed: Oct. 16, 2002

(65) Prior Publication Data

US 2003/0075230 A1 Apr. 24, 2003

(30) Foreign Application Priority Data

Oct. 19, 2001 (DE) ..... 101 51 780

(51) Int. Cl.[7] ..... D03D 47/34

(52) U.S. Cl. ..... 139/452; 139/194; 139/453; 28/186; 28/187; 28/193; 28/194

(58) Field of Search ..... 139/450, 452, 139/194, 200, 201, 232, 224, 370.1

(56) References Cited

U.S. PATENT DOCUMENTS

| | | | | |
|---|---|---|---|---|
| 4,538,650 A | | 9/1985 | Kodama et al. | |
| 4,641,688 A | | 2/1987 | Gehring | |
| 4,817,681 A | | 4/1989 | Krumm et al. | |
| 5,069,395 A | | 12/1991 | Krumm | |
| 5,303,746 A | | 4/1994 | Wahhoud et al. | |
| 5,322,090 A | | 6/1994 | Dornier et al. | |
| 5,332,007 A | | 7/1994 | Wahhoud | |
| 5,335,878 A | | 8/1994 | Jacobsson | |
| 5,398,731 A | | 3/1995 | Schuster | |
| 5,462,094 A | * | 10/1995 | Josefsson et al. | 139/194 |
| 5,476,122 A | | 12/1995 | Schuster et al. | |
| 5,647,404 A | * | 7/1997 | Maina et al. | 139/452 |
| 5,937,915 A | | 8/1999 | Wahhoud | |
| 6,164,340 A | | 12/2000 | Krumm | |
| 6,176,272 B1 | | 1/2001 | Wahhoud et al. | |
| 6,364,235 B1 | | 4/2002 | Wahhoud | |
| 6,418,976 B2 | | 7/2002 | Loehr et al. | |

FOREIGN PATENT DOCUMENTS

| | | |
|---|---|---|
| EP | 0112145 | 6/1984 |
| EP | 0112145 A2 | 6/1984 |
| FR | 2619580 | 2/1989 |
| JP | 61231240 | 10/1986 |
| JP | 61-231240 | 10/1986 |
| JP | 64-52848 | 2/1989 |

* cited by examiner

*Primary Examiner*—Peter Nerbun
*Assistant Examiner*—Brian Kauffman
(74) *Attorney, Agent, or Firm*—W. F. Fasse; W. G. Fasse

(57) ABSTRACT

A supply spool supplies a weft thread through an adjustable actuated thread brake and a thread tension sensor to a weft thread accumulator, from which an accumulated insertion length of the thread is provided to a weft insertion device. The tension sensor provides a measured actual thread tension signal to a control arrangement, which compares the actual tension to a selected rated tension, and, dependent on the deviation therebetween, provides a control signal to an actuator of the thread brake, so that the actual thread tension constantly corresponds to the selected rated tension. Another sensor provides a signal indicating a change from an empty spool to a full spool. Responsive thereto, the control arrangement actuates the thread brake to an adjustable starting brake setting as a coarse adjustment. Then the self-regulating fine adjustment is continued. A constant winding tension and thread accumulation length are achieved in the thread accumulator.

19 Claims, 2 Drawing Sheets

METHOD AND APPARATUS FOR VARIABLY BRAKING THE WEFT THREAD BETWEEN A SUPPLY SPOOL AND A THREAD STORE IN A LOOM

PRIORITY CLAIM

This application is based on and claims the priority under 35 U.S.C. §119 of German Patent Application 101 51 780.7, filed on Oct. 19, 2001, the entire disclosure of which is incorporated herein by reference.

FIELD OF THE INVENTION

The invention relates to a method and an apparatus for adjusting the thread braking force of a weft thread brake arranged between a weft thread supply system and a weft thread reserve store or accumulator.

BACKGROUND INFORMATION

In shuttleless looms, the weft thread is pulled from a stationary weft thread supply system, which comprises, for example, one or more weft thread supply spools, also called bobbins or pirns. Due to the high unwinding or drawing-off speed of the weft thread during the weft insertion in a gripper rapier loom or a gripper shuttle loom, and due to the force-transmitting weft insertion in an air jet or water jet loom, it is generally known to provide a weft thread reserve store or accumulator, also known as a weft storage or pre-winding device, between the supply spools and the weft insertion system. The weft thread accumulator serves to accumulate and hold ready a required length of the weft thread for carrying out the next weft insertion. In this regard, the required length of weft thread is pre-wound onto a drum of the weft thread accumulator, and then during the weft insertion, the required thread length is drawn off from the reserve winding of thread on the drum. The thread length is defined by the number of windings and the drum diameter. When the weft thread being woven has an elastic character, the winding tension of the thread on the drum of the thread accumulator can have a variable and possibly significant influence on the true thread length that is to be inserted into the loom shed. For this reason, it becomes important to control the winding tension of the thread on the drum of the thread accumulator.

The unwinding or drawing-off behavior of the thread from a thread supply spool is variable. For example, for a prescribed unwinding or drawing-off speed, the thread tension will be lower for a relatively full spool, and will be higher for a relatively empty spool (i.e. a spool with only a small amount of remaining thread supply thereon). In order to try to avoid the disadvantageous thread tension variations in this context, and the resulting differing thread lengths in the weft thread accumulator, it is known to use uncontrolled or unregulated thread brake systems on the thread supply path. These known thread brakes are adjusted to a relatively high braking tension, i.e. are adjusted relatively strongly to a braking operation, to ensure that a sufficiently high thread tension is achieved under all operating conditions. The disadvantage of such known uncontrolled thread brakes is that the thread tension achieved thereby is thus generally higher than necessary, and higher than the maximum natural thread tension that arises during the unwinding of the thread supply spool. That in turn means that the thread is loaded, or stressed and strained, more than would be necessary. This causes weak spots in the thread, which lead to thread breaks during the weft insertion. To avoid this, many weavers attempt to operate the loom without a thread inlet or supply brake. Thereby, the weft thread is handled more gently, but unfortunately, the supplied thread lengths exhibit variations that lead to an increase in the weft thread trimming waste.

SUMMARY OF THE INVENTION

In view of the above, it is an object of the invention to provide a thread brake in the area between the thread supply spool and the thread accumulator or storage device, while reducing the mechanical loading of the weft thread caused by the weft thread brake system in this area, and while also achieving a substantially constant winding tension in the weft thread accumulator in order to achieve uniform accumulated thread lengths and a small weft thread waste. The invention further aims to maintain a substantially constant thread supply tension through a thread supply spool change from an empty supply spool to a new full supply spool. The invention further aims to avoid or overcome the disadvantages of the prior art, and to achieve additional advantages, as apparent from the present specification. The attainment of these objects is, however, not a required limitation of the present invention.

The above objects have been achieved according to the invention in an apparatus for variably braking the weft thread between a supply spool and a thread accumulator in a loom, comprising a thread supply system including at least one thread supply spool, a thread accumulator or thread storage device, a thread brake arranged on a weft thread supply path between the thread supply system and the thread accumulator, a weft thread tension sensor arranged on the weft thread supply path between the weft thread brake and the thread accumulator, and a control arrangement or controller that is connected with the thread tension sensor and with an actuator of the thread brake by respective signal transmission links. The controller receives a thread tension signal representing an actual measured value of the thread tension from the thread tension sensor, compares this actual measured value to a nominal, rated or desired value of the thread tension, and then generates a control signal dependent on any difference between the actual value and the desired or rated value of the thread tension. The control signal is supplied to the actuator of the thread brake, so as to control the actuation of the thread brake. Thereby, the weft thread tension is controlled in real time on a continuous or ongoing basis, to be maintained substantially at the rated or desired tension level. As a result, the weft thread is uniformly would onto the drum of the thread accumulator, whereby a uniform pre-winding tension and a uniform accumulated thread length for each successive weft insertion are achieved.

Preferably, the weft thread supply system includes more than one supply spool, and the inventive apparatus further comprises a spool transfer or change sensor, which senses the switch-over from an empty supply spool to a new full supply spool. The signal provided by this sensor, which indicates the change or transfer from the empty spool to the next full spool, is provided to the control arrangement. In response to this signal, the control arrangement provides a suitable control signal to the actuator of the thread brake, which sets the brake to an adjustable or selectable starting brake setting, to achieve a coarse adjustment of the braking force during the time of the thread change from one spool to the next. Thereafter, the fine tension adjustment and closed loop regulation of the thread tension is once again carried out based on the actual measured thread tension as determined by the thread tension sensor, as described above.

The above objects have further been achieved according to the invention in a method of variably braking the weft thread between the supply spool and the thread accumulator. The inventive method involves carrying out the method steps as described above in connection with the operation of the inventive apparatus.

According to the invention, using the described braking system, the required braking force can be continuously controlled or regulated in a closed loop and self-regulating fashion, dependent on the actual existing thread tension as measured with a thread tension sensor. By further providing the spool change sensor, the resulting spool change signal allows the system to switch rapidly, or even preemptively, to a new initial setting of the adjustable braking for the different tension conditions that will prevail with the new full spool. Particularly, a substantial change of the natural supply tension is expected in connection with a change from an empty spool to a new full spool. The spool change sensor gives an advance notice of this expected tension change so that the thread braking system can be accordingly adjusted in a rapid manner. For example, the thread brake can be set to a nominal starting brake setting for the thread spool change period. Immediately thereafter, the normal regulation again continues the fine adjustment of the braking force in a self-regulating manner.

Thereby, according to the invention, it is ensured that the weft thread is only braked to such an extent, at all times, as is necessary to achieve a constant winding tension on the drum of the thread accumulator or storage device. For example, that means that the thread brake will be adjusted to apply a greater braking effect while the weft thread is being drawn off from a relatively fully supply spool, while the thread brake will be adjusted to a nearly open condition, i.e. applying essentially no braking effect, when the weft thread is being drawn off from a supply spool that is nearly empty. In this manner, according to the invention, the weft thread is braked and thus tensioned only exactly as much as necessary (or no more than necessary), and therefore the thread loading is optimized (i.e. unnecessary strains and stresses on the thread are avoided), and the winding tension of the thread on the drum of the thread accumulator is maintained substantially constant. Thus, the thread waste length can be minimized and maintained essentially constant.

According to the invention, basically any type of thread brake can be used, as long as the thread brake can apply a variable controllable tension or braking force and effect. Preferably according to the invention, the thread brake is embodied as a leaf spring brake or as a thread looping or wrapping brake.

BRIEF DESCRIPTION OF THE DRAWINGS

In order that the invention may be clearly understood, it will now be described in connection with two example embodiments, with reference to the accompanying drawings, wherein.

DETAILED DESCRIPTION OF A PREFERRED EXAMPLE EMBODIMENT AND OF THE BEST MODE OF THE INVENTION

Figure 1:
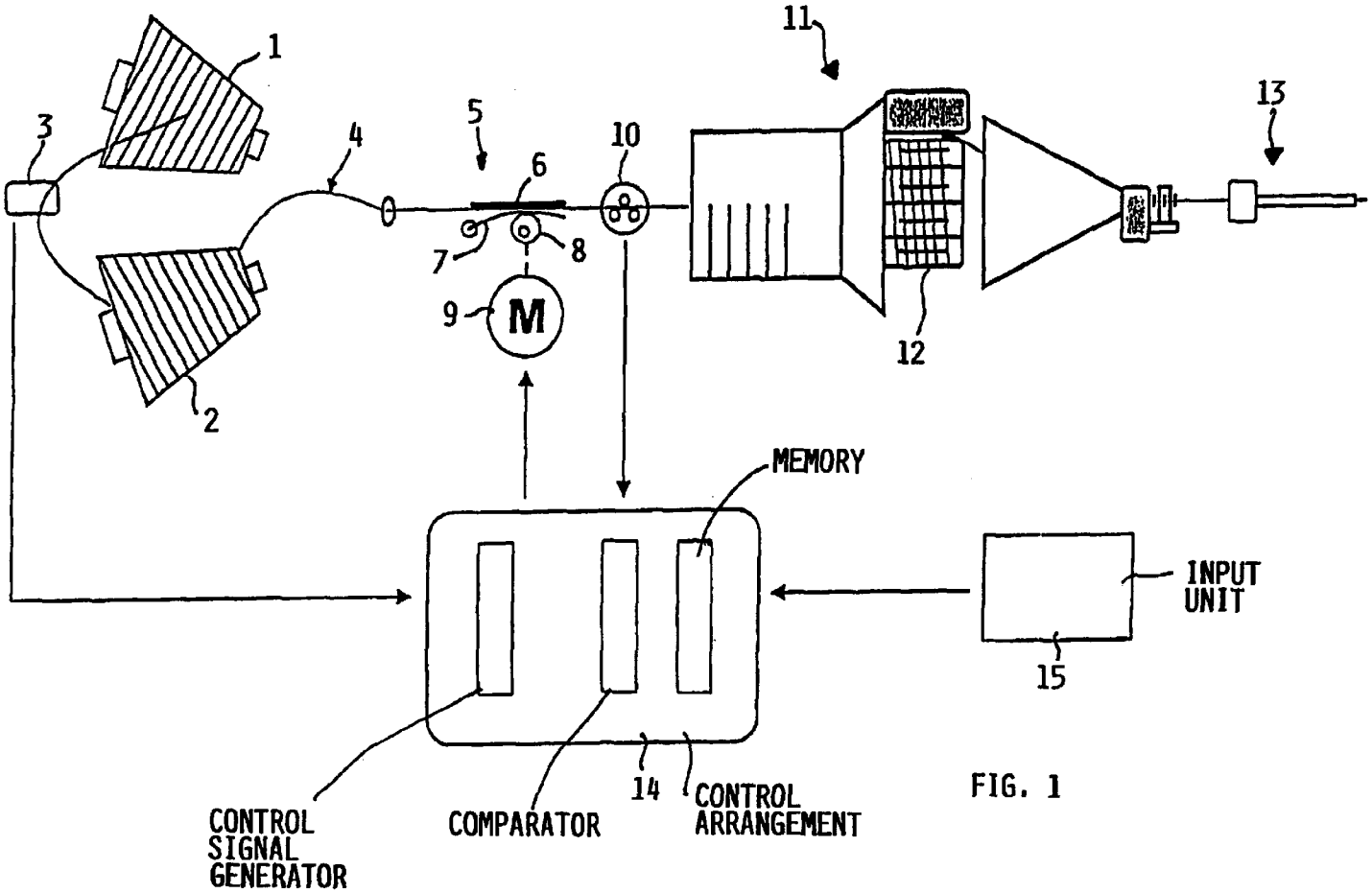
FIG. 1 is a schematic diagram of the weft thread path between a thread supply spool and the weft insertion member, and through a regulated thread brake according to a first embodiment of the present invention.
Figure 2:
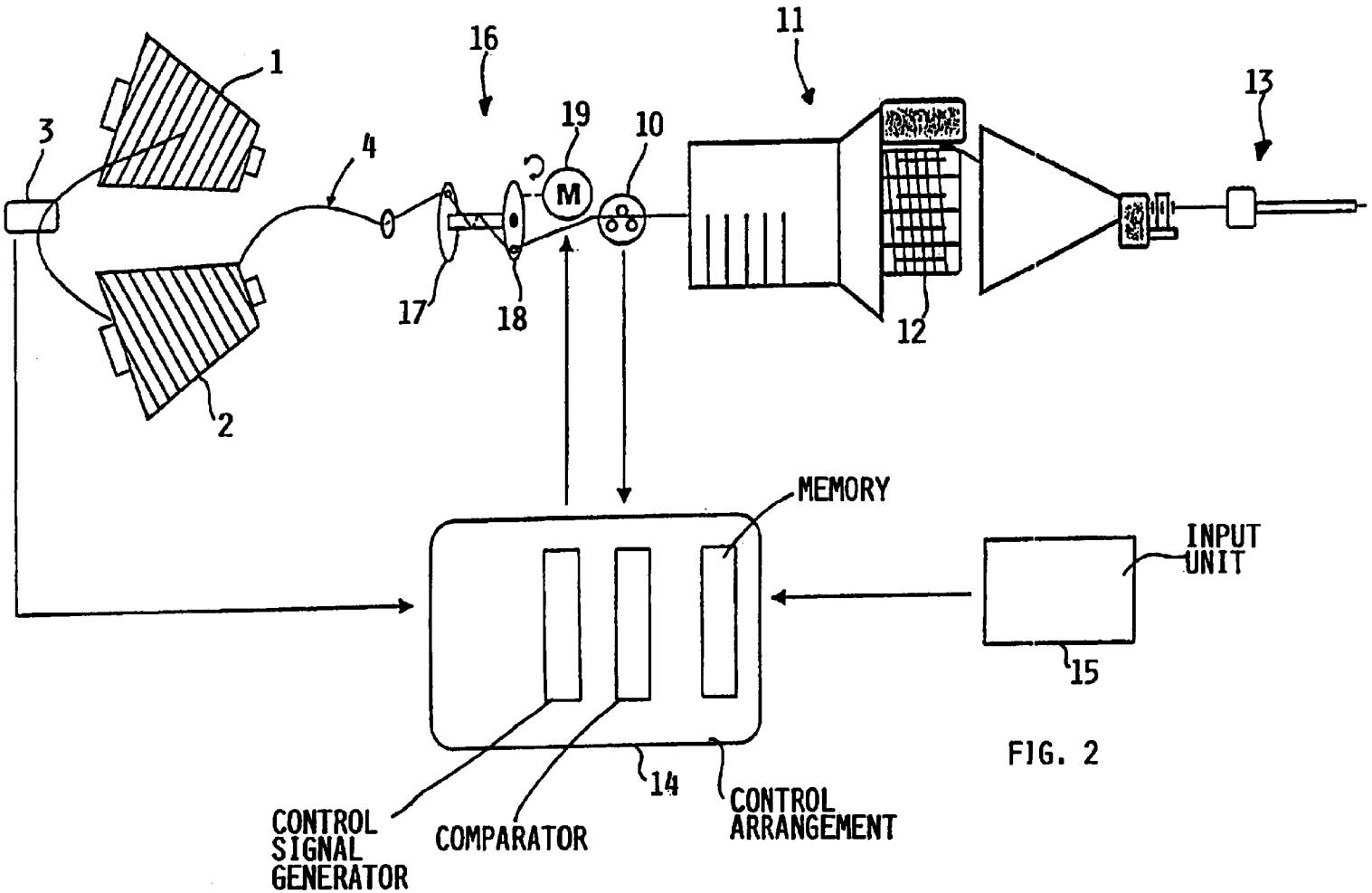
FIG. 2 is a schematic diagram of the weft thread path between a thread supply spool and the weft insertion member, and through a regulated thread brake according to a second embodiment of the present invention

As shown in FIGS. 1 and 2 respectively in connection with two embodiments of the inventive apparatus, a weft thread 4 is drawn off from a thread supply spool 2 of a thread supply system, and guided along a thread supply path through a weft thread brake 5 or 16, respectively, to a thread accumulator or storage device 11. An appropriate thread length of the weft thread required for a respective weft insertion is wound onto the drum 12 of the thread accumulator 11, and in the next insertion cycle, this length of accumulated thread is inserted into the loom shed of the loom by the weft insertion device or member 13, such as a rapier gripper or gripper shuttle, or even the fluid jets of a fluid jet loom. The winding tension of the thread 4 on the drum 12 of the thread accumulator 11 is to be maintained at a substantially constant level, in order to ensure a substantially constant or uniform insertion length of the accumulated weft thread 4.

According to the invention, this constant winding tension and accumulated thread length are achieved in that the thread tension of the weft thread 4 is controlled or regulated by the inventive braking system at a location upstream of the thread accumulator 11. Particularly, the actual thread tension of the weft thread 4 is measured in an ongoing or continuous manner by a thread tension sensor 10 arranged on the thread path upstream of the thread accumulator 11, and especially between the thread brake 5, 16 and the thread accumulator 11. The measured actual tension signal of the sensor 10 is electronically provided to a control arrangement or controller 14, for example as an electrical signal via an electrical conductor, or as an optical signal via a fiber optic cable, or even as a radio signal or an infrared signal via a corresponding wireless remote transmission link.

The control arrangement 14 may be embodied as a portion or component of the overall loom control, and may comprise any known analog and/or digital hardware and/or software suitable for carrying out the functions described herein. As an example, the control arrangement 14 includes a memory, a comparator, and a control signal generator connected to each other. In the control arrangement 14, and particularly in the comparator thereof, the measured actual thread tension is compared with a nominal, desired, or rated thread tension which is stored in the memory. If the actual thread tension deviates from the rated thread tension, then the control signal generator of the control arrangement 14 generates a corresponding control signal responsive to the difference between the actual thread tension and the rated thread tension.

This control signal is transmitted to the actuator of the weft thread brake 5, 16, for correcting or regulating the braking force, which varies or adjusts the thread tension, until the actual thread tension measured by the sensor 10 corresponds to the rated thread tension. Thus, as described above, the sensor 10, the control arrangement 14, and the controlled thread brake 5, 16 provide a self-regulating loop that continuously regulates the actual thread tension to the desired or rated tension value. This does not require 100% accuracy or equivalence between the actual and rated thread tension values, but rather simply correspondence of these values within a usual tolerance range of such feedback regulation loops, for example within 1 or 2% deviation.

The desired tension value can be input as a prescribed rated tension value, via an input unit 15, such as a keyboard or a touch-sensitive input screen with selectable menu options and the like. This input unit 15 can be a part or component of the input unit of the overall loom control. Various other adjustment parameters can also be input into the control arrangement 14 via the input unit 15, whereby these input values are, for example, dependent on the type, quality, and other parameters of the weft thread being used.

An initial coarse adjustment brake setting value can also be specified via the input unit 15.

As the amount of remaining thread on the supply spool 2 diminishes, the thread tension of the weft thread 4 will also change. Namely, when unwinding or drawing off the weft thread 4 from a relatively full supply spool 2, the thread tension will be lower than when drawing off the thread from a supply spool 2 having a relatively small thread supply amount remaining thereon, respectively in connection with the same prescribed thread unwinding or drawing-off speed. As the supply spool 2 becomes emptier, the thread brake 5, 16 will automatically adjust the braking force so that the resultant actual thread tension measured with the tension sensor 10 will be self-regulated to remain substantially constantly equal to the desired rated thread tension.

When the first supply spool 2 becomes empty, so that it is necessary to switch-over or change to the next full supply spool 1, an abrupt change of the thread tension occurs in connection with this thread supply spool change. In order to allow the thread brake 5, 16 to act preemptively to control the resulting actual thread tension in connection with the drastic supply tension variation during the spool charge-over, the inventive apparatus preferably includes a spool change sensor 3 that senses the spool change and provides a corresponding signal to the control arrangement 14. This triggers the control arrangement 14 to switch the thread brake 5, 16 to an adjustable or previously selected initial coarse adjustment setting of the braking force. This coarse adjustment is maintained for a pre-determined time interval during the thread spool change-over, or until a new stabilized thread tension value is sensed by the thread tension sensor 10. At that time, the above described fine adjustment of the braking force is once again carried out in a self-regulating manner to bring the actual measured thread tension into correspondence with the desired rated thread tension.

In the arrangement of FIG. 1, the weft thread brake is embodied as a leaf spring brake 5 comprising a fixed brake member 6 and a movable brake member 7 that is embodied as a leaf spring. The weft thread 4 is guided between the fixed brake member 6 and the movable brake member 7. An actuator is connected to the movable brake member 7, so as to move the brake member 7 relative to the fixed brake member 6. The actuator is, for example, a motor 9 with a rotational output shaft connected to an eccentric member or cam disk 8 so as to selectively rotationally drive the eccentric member 8. The eccentric member 8 is operatively connected to or bears against the movable brake member 7, so as to adjust the pressing force of the movable brake member 7 against the fixed brake member 6. Instead of the motor 9 and the eccentric member 8, the actuator may comprise a variable linear actuator, for example. Thereby, the braking force or braking effect exerted by the leaf spring brake 5 on the weft thread 4 is correspondingly adjusted.

The arrangement of FIG. 2 involves a weft thread brake embodied as a thread looping or wrapping brake, which comprises a disk-shaped fixed brake member 17 and a disk-shaped movable brake member 18 that are connected to each other by a shaft or axle. The two disk-shaped brake members 17 and 18 each have a respective thread guide eyelet on their respective rim, through which the weft thread is guided. An actuator such as a motor 19 selectively rotationally moves the movable disk member 18 relative to the fixed disk member 17, whereby the weft thread 4 is looped or wrapped either more or less around the axle interconnecting the two disk members 17 and 18. By this variable degree of winding or wrapping, the braking effect exerted on the weft thread 4 is correspondingly varied.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. An apparatus for supplying and variably braking a weft thread in a loom, comprising:

a weft thread accumulator;

a weft thread supply system comprising a first weft thread supply spool that supplies a weft thread extending along a thread path from said weft thread supply system to said weft thread accumulator;

an adjustable weft thread brake having an adjustable braking effect, arranged on said thread path between said weft thread supply system and said weft thread accumulator;

a thread tension sensor that is arranged on said thread path between said weft thread brake and said weft thread accumulator, and that is adapted to sense an actual thread tension of said weft thread and to generate a thread tension signal dependent on and indicative of said actual thread tension; and a control arrangement connected with said thread tension sensor by a first signal transmission link from said thread tension sensor to said control arrangement, and connected with said adjustable weft thread brake by a second signal transmission link from said control arrangement to said adjustable weft thread brake.

2. The apparatus according to claim 1, wherein said control arrangement comprises a memory that stores a selected nominal thread tension value, a signal evaluating arrangement that receives said thread tension signal via said first signal transmission link and carries out an evaluation of said thread tension signal with respect to said actual thread tension relative to said selected nominal thread tension value, and a control signal generator that generates a control signal responsive to a result of said evaluation carried out by said signal evaluating arrangement and that transmits said control signal to said adjustable weft thread brake via said second signal transmission link.

3. The apparatus according to claim 2, further comprising an input unit that is connected to said control arrangement and that is adapted to enable a user thereof to input said selected nominal thread tension value to be stored in said memory.

4. The apparatus according to claim 2, wherein said signal evaluating arrangement comprises a comparator arrangement that compares said actual thread tension to said selected nominal thread tension value so as to determine any deviation existing therebetween, wherein said control signal generator generates said control signal responsive to said deviation, and wherein said control signal adjustably actuates said adjustable weft thread brake so that said actual thread tension corresponds to said selected nominal thread tension value.

5. The apparatus according to claim 2, wherein said weft thread supply system further comprises a second weft thread supply spool, and further comprising a spool change sensor that is arranged to sense a change-over from said weft thread being supplied by said first weft thread supply spool to said weft thread being supplied by said second weft thread supply spool, and that is adapted to provide a spool change signal responsive to and indicative of said change-over, wherein said spool change sensor is connected to said control arrangement to provide said spool change signal thereto, and wherein said control signal generator switches said control signal to a specified initial brake setting in response to said spool change signal.

6. The apparatus according to claim 1, wherein said control arrangement controls said adjustable weft thread brake to adjust a braking effect applied to said weft thread dependent on said actual thread tension.

7. The apparatus according to claim 1, wherein said weft thread supply system further comprises a second weft thread supply spool, and further comprising a spool change sensor that is arranged to sense a change-over from said weft thread being supplied by said first weft thread supply spool to said weft thread being supplied by said second weft thread supply spool, wherein said spool change sensor is connected to said control arrangement by a third signal transmission link.

8. The apparatus according to claim 1, wherein said adjustable weft thread brake comprises first and second brake members and a power actuator connected to at least said first brake member so as to vary a pressing force or to move at least said first brake member relative to said second brake member.

9. The apparatus according to claim 1, wherein said adjustable weft thread brake comprises a leaf spring brake.

10. The apparatus according to claim 9, wherein said leaf spring brake comprises a fixed brake member, a movable leaf spring, a motor with a rotatable output shaft, and an eccentric cam that is mounted on said shaft and bears against said movable leaf spring, and wherein said weft thread runs between said fixed brake member and said movable leaf spring.

11. The apparatus according to claim 1, wherein said adjustable weft thread brake comprises a thread wrapping brake.

12. The apparatus according to claim 11, wherein said thread wrapping brake comprises a fixed member with a first eyelet, a rotatable member with a second eyelet, a shaft extending between and connecting said rotatable member and said fixed member, and a motor connected so as to variably rotate said rotatable member relative to said fixed member, and wherein said weft thread runs through said first eyelet and said second eyelet and around said shaft.

13. A method of supplying and variably braking a weft thread in a loom, comprising the steps:

a) supplying a weft thread from a first supply spool to a weft thread accumulator;

b) applying a variable braking effect to said weft thread at a braking location between said first supply spool and said weft thread accumulator;

c) sensing an actual thread tension of said weft thread at a sensing location between said braking location and said weft thread accumulator; and d) adjusting said variable braking effect dependent on said actual thread tension.

14. The method according to claim 13, further comprising comparing said actual thread tension to a selected nominal thread tension value and determining any deviation therebetween, and wherein said step d) comprises adjusting said variable braking effect responsive to and dependent on said deviation.

15. The method according to claim 14, wherein said step d) comprises adjusting said variable braking effect so as to drive said deviation toward zero in a self-regulating closed loop manner.

16. The method according to claim 13, wherein said steps c) and d) are carried out continuously.

17. The method according to claim 13, further comprising the steps:

e) switching from said supplying of said weft thread from said first supply spool to supplying said weft thread from a second supply spool;

f) sensing said switching;

g) in response to said sensing of said switching, adjusting said variable braking effect to a coarse starting adjustment independently of said actual thread tension; and h) after said step g), then returning to carrying out said step d).

18. The method according to claim 17, wherein said step h) comprises returning to carrying out said step d) after a specified time interval following said step g).

19. The method according to claim 17, wherein said step h) comprises returning to carrying out said step d) after a new value of said actual thread tension has been sensed by said step c) and has stabilized following said step g).

* * * * *